US010018946B2

(12) United States Patent
Katakura

(10) Patent No.: US 10,018,946 B2
(45) **Date of Patent: *Jul. 10, 2018**

(54) FIXING DEVICE THAT FIXES IMAGES OF DECOLORABLE AND NON-DECOLORABLE MATERIALS

(71) Applicants: KABUSHIKI KAISHA TOSHIBA, Tokyo (JP); TOSHIBA TEC KABUSHIKI KAISHA, Tokyo (JP)

(72) Inventor: Hiroshi Katakura, Numazu Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/421,326

(22) Filed: Jan. 31, 2017

(65) Prior Publication Data

US 2017/0139357 A1 May 18, 2017

Related U.S. Application Data

(63) Continuation of application No. 15/004,562, filed on Jan. 22, 2016, now Pat. No. 9,594,333, which is a continuation of application No. 14/829,751, filed on Aug. 19, 2015, now Pat. No. 9,285,731.

(30) Foreign Application Priority Data

Aug. 21, 2014 (JP) ..... 2014-168651

(51) Int. Cl.
*G03G 15/20* (2006.01)

(52) U.S. Cl.
CPC ..... *G03G 15/2039* (2013.01)

(58) Field of Classification Search
None
See application file for complete search history.

(56) References Cited

U.S. PATENT DOCUMENTS

| | | | | |
|---|---|---|---|---|
| 7,945,189 | B2 | 5/2011 | Yamashita | |
| 2007/0217807 | A1 | 9/2007 | Maeda et al. | |
| 2009/0060561 | A1 | 3/2009 | Okabayashi | |
| 2012/0321335 | A1 * | 12/2012 | Fujiwara | G03G 15/2078 399/69 |
| 2013/0002782 | A1 | 1/2013 | Kawaguchi et al. | |
| 2013/0108339 | A1 | 5/2013 | Mita et al. | |
| 2014/0240724 | A1 | 8/2014 | Kinouchi et al. | |

FOREIGN PATENT DOCUMENTS

| | | |
|---|---|---|
| JP | 5444418 B2 | 3/2014 |

* cited by examiner

*Primary Examiner* — Victor Verbitsky
(74) *Attorney, Agent, or Firm* — Patterson & Sheridan, LLP

(57) ABSTRACT

A fixing device includes a roller, a pressing member pressed against the roller, such that when a sheet having an unfixed image is passed thorough a nip formed between the roller and the pressing member, the unfixed image is fixed on the sheet, a first heater configured to heat the roller, a second heater configured to heat the pressing member, and a controller configured to control the second heater, such that a time-averaged heat generation by the second heater when an image of a decolorable material is fixed is greater than a time-averaged heat generation by the second heater when an image of a non-decolorable material is fixed.

20 Claims, 8 Drawing Sheets

FIXING DEVICE THAT FIXES IMAGES OF DECOLORABLE AND NON-DECOLORABLE MATERIALS

CROSS-REFERENCE TO RELATED APPLICATIONS

This application is a continuation of U.S. patent application Ser. No. 15/004,562, filed on Jan. 22, 2016, which is a continuation of U.S. patent application Ser. No. 14/829,751, filed on Aug. 19, 2015, now U.S. Pat. No. 9,285,731, issued on Mar. 15, 2016, which is based upon and claims the benefit of priority from Japanese Patent Application No. 2014-168651 filed Aug. 21, 2014, the entire contents of each of which are incorporated herein by reference.

FIELD

Embodiments described herein relate to a fixing device, an image forming apparatus having the same, and an image forming method.

BACKGROUND

An image forming apparatus of one type forms an image on a sheet (medium) and fixes the image on the sheet. Such an image forming apparatus may form the image with a non-decolorable material or a decolorable material. When the image is formed on the sheet with the decolorable material, the sheet can be reused after the image is erased.

In order to fix the decolorable material onto the sheet, the sheet needs to be heated, but not too much such that an image of the decolorable material is not erased.

DETAILED DESCRIPTION

An embodiment provides an image forming apparatus having a fixing unit and an image forming method which can fix images of both decolorable and non-decolorable materials.

According to an embodiment, a fixing device includes a roller, a pressing member pressed against the roller, such that when a sheet having an unfixed image is passed thorough a nip formed between the roller and the pressing member, the unfixed image is fixed on the sheet, a first heater configured to heat the roller, a second heater configured to heat the pressing member, and a controller configured to control the second heater, such that a time-averaged heat generation by the second heater when an image of a decolorable material is fixed is greater than a time-averaged heat generation by the second heater when an image of a non-decolorable material is fixed.

Hereinafter, an image forming apparatus and an image forming method of an embodiment will be described with reference to the drawings.

Figure 1:
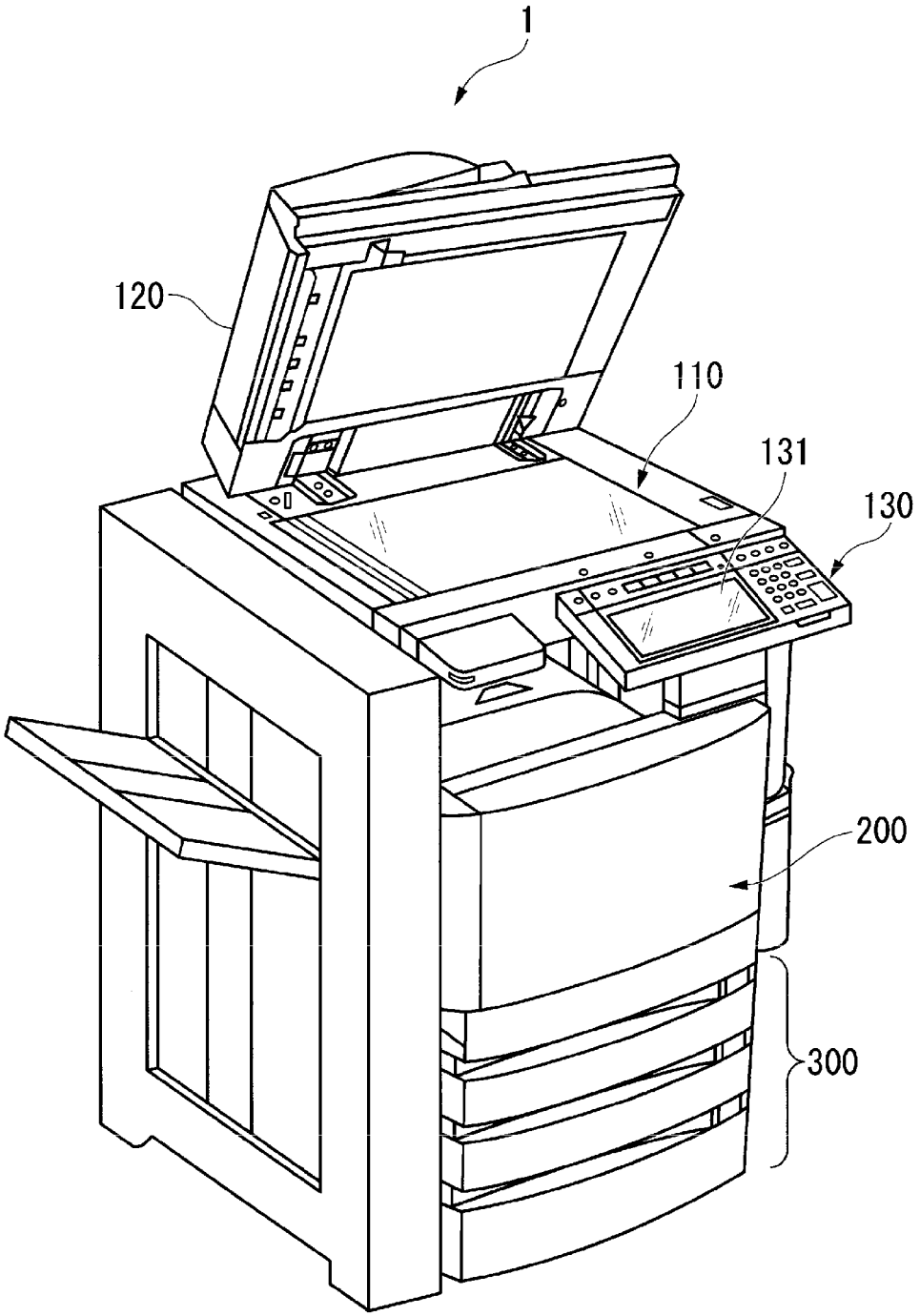
FIG. 1 is an exterior view of an image forming apparatus according to an embodiment.

FIG. 1 is an exterior view of an image forming apparatus 1 according to the present embodiment. In FIG. 1, the image forming apparatus 1 is a multi function peripheral (MFP). The image forming apparatus 1 reads an image formed on a sheet-like medium (hereinafter, referred to as "sheet") such as a paper sheet, and generates digital data (image file). The image forming apparatus 1 forms an image on a sheet using a coloring agent, based on the digital data. A specific example of the coloring agent includes toner. The coloring agent is either a decolorable agent or a non-decolorable agent. A toner material used as the decolorable agent is decolored when an external energy is applied thereto. Applying the external energy includes, for example, heat, light having a specific wavelength, and a pressure. In the present embodiment, the meaning of "decoloring" is that the image of a color (including an achromatic color such as white or black as well as a chromatic color) different from color of the sheet becomes visually unrecognizable.

The image forming apparatus 1 includes an image reading unit 110, an automatic feeding unit 120, a control panel 130, a printing unit 200, and a sheet tray 300.

The image reading unit 110 reads an image formed on a sheet using a sensor and generates digital data (image data). The image reading unit 110 is a color scanner that is provided with, for example, a contact image sensor (CIS), charge coupled devices (CCD), and the like.

The automatic feeding unit 120 guides a document (sheet) to a reading position. In FIG. 1, the reading position is an upper portion of the image reading unit 110. The automatic feeding unit 120 sends the document, of which the image reading has been completed, from the reading position to a discharging position. Then, the automatic feeding unit 120 guides the next document to the reading position.

The control panel 130 receives an instruction from a user. The instruction from a user means an operation of the image forming apparatus 1. Specific examples of the operation include follows: an operation of the printing unit 200 to start image formation; an operation to select the coloring agent, a decolorable agent or a non-decolorable agent; and an operation of the image reading unit 110 to read images from a document sheet. The control panel 130 includes a display unit 131. The display unit 131 is operated as an output interface, and displays characters or images. The display unit 131 is operated as an input interface, and receives an instruction from a user. The display unit 131 is, for example, a liquid crystal display including a touch panel.

The printing unit 200 forms an image on a sheet with one or more coloring agents. The printing unit 200 forms the image based on image data generated by the image reading unit 110 or image data received from an external apparatus. The printing unit 200 forms the image on the sheet with either a decolorable agent that can be decolored by heat or a non-decolorable agent. The image formed on the sheet is, for example, an output image referred to as a hard copy, a printout, and the like.

The sheet tray 300 supplies a sheet having an arbitrary size, which is used for an image output, to the printing unit 200.

Figure 2:
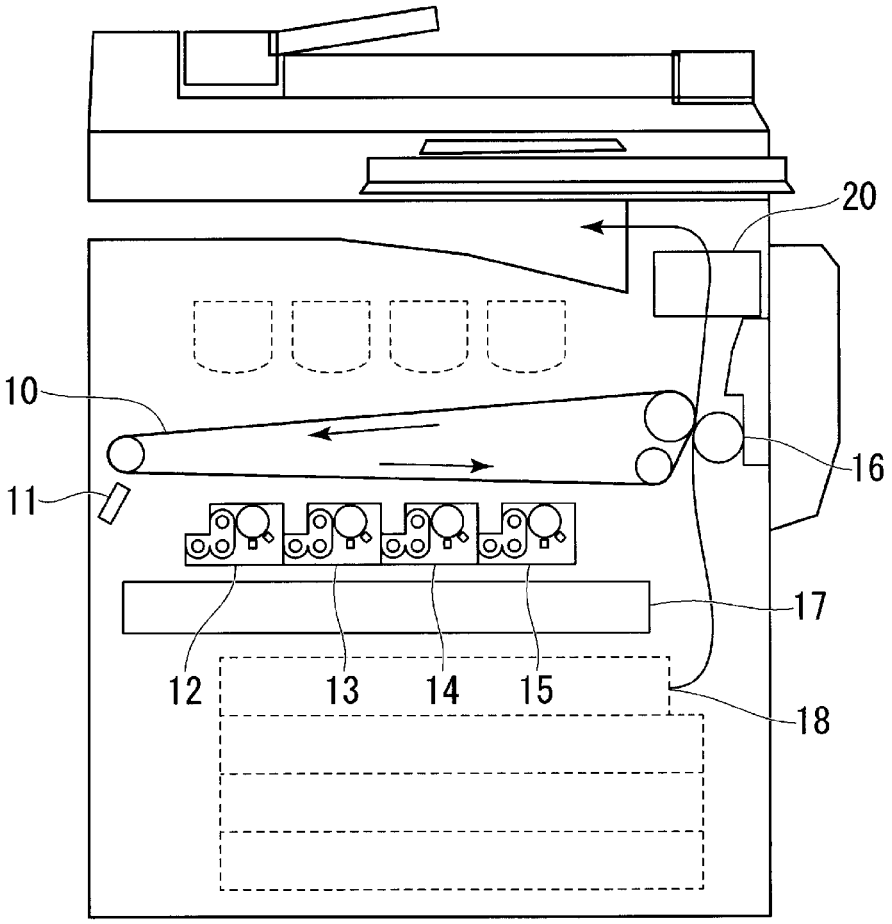
FIG. 2 is an internal configuration of the image forming apparatus.

FIG. 2 illustrates an internal configuration of the image forming apparatus 1 according to the present embodiment. The image forming apparatus 1 illustrated in FIG. 2 is an electrophotographic image forming apparatus. The image forming apparatus 1 includes an intermediate transfer member 10, a blade 11 (a toner removing unit), image forming units 12 to 15, a secondary transfer roller 16, a control unit 17, a sheet feeding unit 18, and a fixing device 20.

The intermediate transfer member 10 is an endless belt, and rotates in a direction indicated by arrows in FIG. 2.

The blade 11 removes toner attached on the intermediate transfer member 10.

The image forming units 12 to 15 form an image using toners of colors (four different colors in FIG. 2).

The secondary transfer roller 16 rotates to transfer, to the sheet, the image of the toner formed on the intermediate transfer member 10.

The control unit 17 controls the image forming units 12 to 15 and the fixing device 20.

The sheet feeding unit 18 feeds a sheet.

The fixing device 20 fixes the image of the toner, which is transferred to the sheet, to the sheet by heating and pressing the image.

The image forming apparatus 1 converts image data corresponding to the image to be formed to image data units of different colors through an image process. The image forming apparatus 1 converts the image data, for example, to image data units of yellow (Y), magenta (M), cyan (c), black (K).

The image forming apparatus 1 includes a first transfer process and a second transfer process. In the first transfer process, each of the image forming units 12 to 15 transfers an image of a corresponding color on the intermediate transfer member 10, so that the images are overlapped. In the second transfer process, the secondary transfer roller 16 collectively transfers the overlapped image of toners formed on the intermediate transfer member 10 to the sheet.

Figure 3:
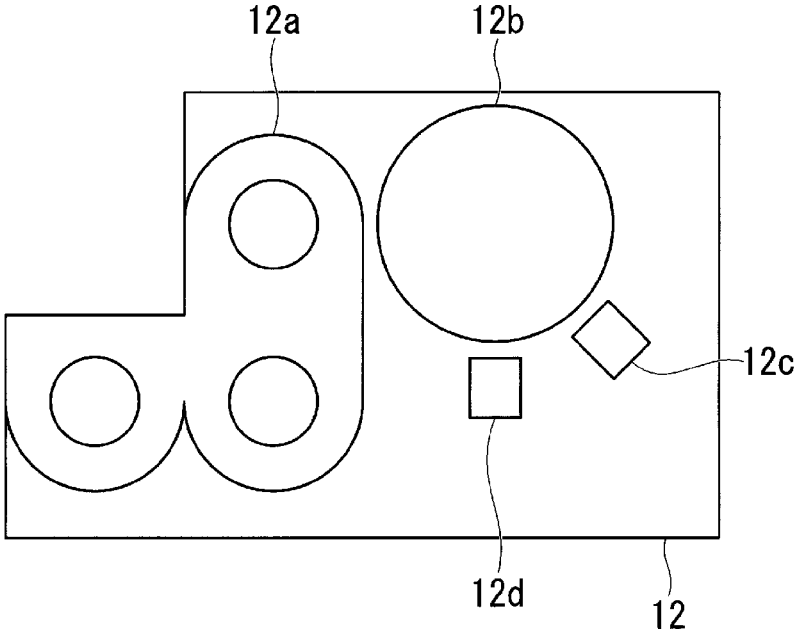
FIG. 3 illustrates an image forming unit of the image forming apparatus.

FIG. 3 illustrates an example of the image forming unit 12. The image forming unit 12 includes a developing device 12*a*, a photosensitive drum 12*b*, a charging device 12*c*, and an exposing unit 12*d*.

The developing device 12*a* causes the photosensitive drum 12*b* to hold toners. The developing device 12*a* contains developer, and the developer contains the toners.

The photosensitive drum 12*b* is an image carrier (image carrying unit). The photosensitive drum 12*b* includes a photoreceptor (photosensitive area) on an outer circumferential surface thereof. The photoreceptor is, for example, an organic photoconductor (OPC).

The charging device 12*c* uniformly charges the surface of the photosensitive drum 12*b*.

The exposing unit 12*d* irradiates (exposes) the photosensitive drum 12*b* with light. The exposing unit 12*d* includes an exposure light source such as a laser or LED.

The photosensitive drum 12*b* is charged by the charging device 12*c*. Next, the exposing unit 12*d* exposes the charged photosensitive drum 12*b* according to the image data unit of a color. As a result, an electrostatic latent image is formed on the surface of the photosensitive drum 12*b*. The electrostatic latent image corresponds to the image data unit of the color. The electrostatic latent image on the surface of the photosensitive drum 12*b* is developed by the developer of the developing device 12*a*. That is, the image of the toner is formed on the surface of the photosensitive drum 12*b*. The image of the toner on the photosensitive drum 12*b* is transferred to the intermediate transfer member 10 by an electric field.

The image forming units 13 to 15 have the same configuration and perform the same operation as those of the image forming unit 12 except for the developer contained therein, and thus the description thereof will not be repeated.

The image formed with toner of each color is transferred to the intermediate transfer member 10 such that the images are overlapped. In addition, each of the image forming units 12 to 15 contains both the decolorable agent and the non-decolorable agent, and thus the image of either agent can be formed by selecting the decolorable agent or the non-decolorable agent.

The sheet is transferred from the sheet feeding unit 18 via a paper transport path. The sheet is then discharged to a discharging tray via the secondary transfer roller 16 and the fixing device 20.

Figure 4:
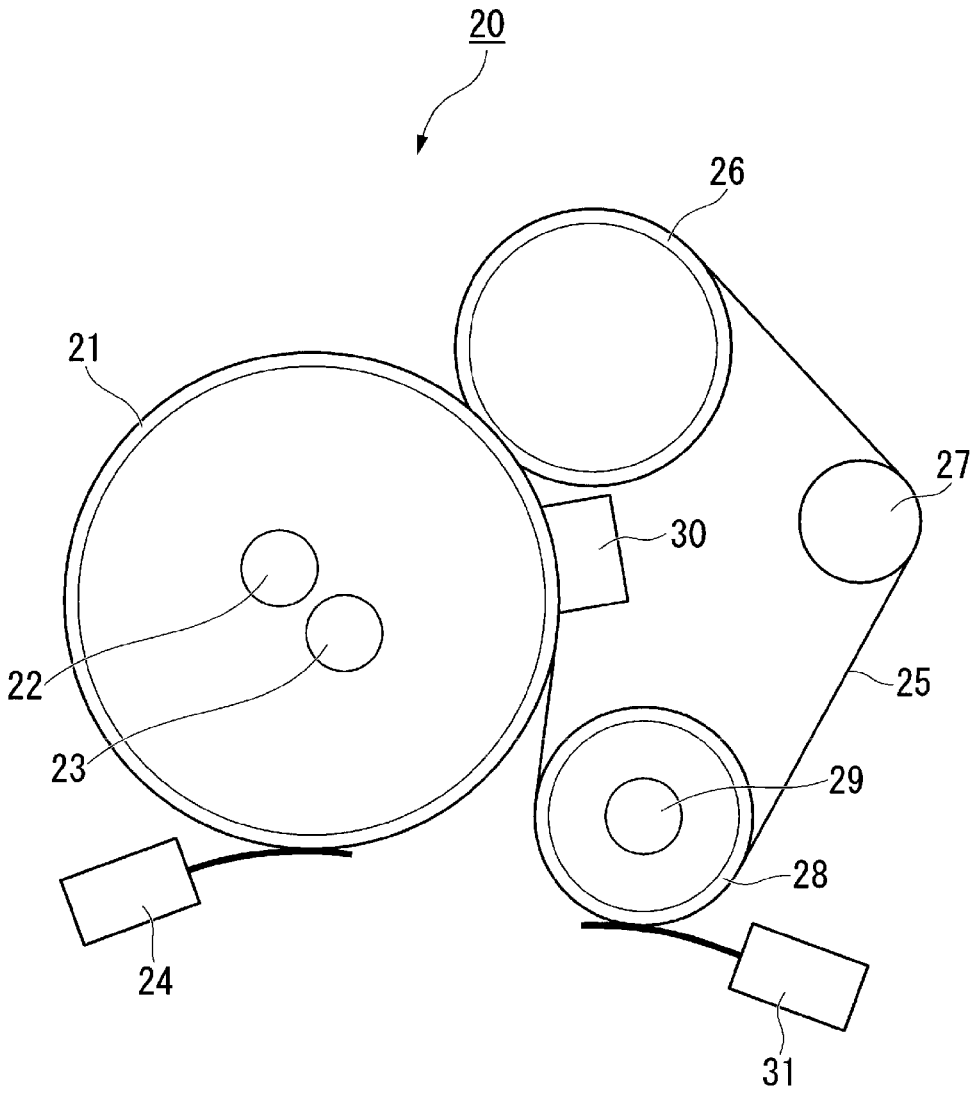
FIG. 4 is a cross-sectional view of a fixing device of the image forming apparatus illustrated in FIG. 2.

FIG. 4 is a cross-sectional view of the fixing device 20 illustrated in FIG. 2. The fixing device 20 includes a heating roller (fixing roller) 21, an heating roller (HR) center lamp 22, an HR side lamp 23, an HR thermistor (fixing roller thermistor) 24, a pressing belt 25, an outlet pressing roller 26, a tension roller 27, a pressing belt heating roller 28, a pressing belt lamp 29, a nip pad 30, and a pressing belt thermistor 31.

The heating roller 21 is a specific example of a fixing member. The heating roller 21 is heated by a heating source equipped therein. The heating roller 21 includes the HR center lamp 22 and the HR side lamp 23 in a space thereof. The heating roller 21 includes, for example, an aluminum substrate having a thickness of 1.0 [mm]. The outer circumferential surface of the heating roller 21 is coated with a release layer. The release layer is a fluorine coating layer. The release layer may be an elastic layer, in particular, a tetrafluoroethylene-perfluoroalkyl vinyl ether copolymer (PFA) tube. The heating roller 21 is a roller (cylindrical rotary object), for example, having a diameter of 45 [mm].

The HR center lamp 22 and the HR side lamp 23 are specific examples of a first heater. The HR center lamp 22 and the HR side lamp 23 heat the heating roller 21. The HR center lamp 22 and the HR side lamp 23 are, for example, a heating source such as a halogen lamp. The HR center lamp 22 and the HR side lamp 23 may heat the entire heating roller 21, respectively. Alternatively, the HR center lamp 22 and the HR side lamp 23 may heat different portions of the heating roller 21 respectively. For example, the HR center lamp 22 may heat a center portion of the heating roller 21 in a longitudinal direction. For example, the HR side lamp 23 may heat end portions of the heating roller 21 in the longitudinal direction. In FIG. 4, energy consumption of the HR center lamp 22 and the HR side lamp 23 is 600 W, in total.

The HR thermistor 24 detects the temperature of the heating roller 21. The HR thermistor 24 may be arranged at the center portion and the side portion of the heating roller 21.

The pressing belt 25 is a specific example of a pressing member. The pressing belt 25 is an endless belt. The pressing belt 25 surrounds the outlet pressing roller 26, the tension roller 27, and the pressing belt heating roller 28 thereby stretching around the three rollers 26-28. The pressing belt 25 is a belt having a diameter of, for example, 50 [mm].

The outlet pressing roller 26 is a roller having a diameter of, for example, 21 [mm]. The outlet pressing roller 26 is formed by bonding solid rubber having a thickness of 2 [mm] to a core bar of SUS having a diameter of, for example, 17 [mm], so as to surround the core bar. The pressing belt 25 is pressed by a pressing mechanism (not illustrated), and thus a contact portion of the heating roller 21 and the outlet pressing roller 26 is press-contact with a pressure of 290 [N].

The tension roller 27 applies tension to the pressing belt 25. The tension roller 27 is a roller having a diameter, for example, 10 [mm]. The tension roller 27 is configured such that the outer periphery of SUS is covered with a PFA tube having a thickness of 50 [μm].

The pressing belt heating roller 28 is a specific example of the pressing member. The pressing belt heating roller 28 performs heating using a built-in heating source. The pressing belt heating roller 28 has the pressing belt lamp 29 as the built-in heating source. The pressing belt heating roller 28 is a roller having a diameter of, for example, 17 [mm]. The pressing belt heating roller 28 includes a substrate made of aluminum having a thickness of, for example, 1.0 [mm]. The front surface of the pressing belt heating roller 28 may be covered with a release layer. The release layer is provided to improve release properties between the surface of the pressing belt heating roller 28 and toner. The release layer is a layer formed of, for example, fluororesin or silicon rubber.

The pressing belt lamp 29 is a specific example of a second heater. The pressing belt lamp 29 heats the pressing belt heating roller 28. The pressing belt 25 is heated by the heat transferred from the pressing belt heating roller 28. The pressing belt lamp 29 is, for example, a heating source such as a halogen lamp. In FIG. 4, the pressing belt lamp 29 is a halogen lamp of which energy consumption is 300 W.

The nip pad 30 is urged by a pressing mechanism (not illustrated) and presses the pressing belt 25 against the outer circumferential surface of the heating roller 21 from the inner side of the pressing belt 25. The pressing belt 25 and the heating roller 21 are in press-contact by the nip pad 30. The nip pad 30 is a prism-shaped member having a width of, for example, 8.4 [mm]. The nip pad 30 includes, for example, silicon rubber having a thickness of 3.5 [mm] bonded to an auxiliary metal plate. A sliding sheet for reducing friction may be provided between the nip pad 30 and the pressing belt 25.

The pressing belt thermistor 31 detects the temperature of the pressing belt 25. The pressing belt thermistor 31 is arranged at the center part of the pressing belt 25 in a width direction.

The fixing device 20 passes a sheet on which an image of unfixed toner (image of unfixed developer) is conveyed in a direction indicated by an arrow in FIG. 2. The sheet and the image of the toner thereon are heated and pressed when the sheet passes through the nip between the heating roller 21 and the pressing belt 25. The sheet passing through the nip is heated from the both sides of the heating roller 21 and the pressing belt 25. Accordingly, the image of the toner is fixed on the sheet.

Figure 5:
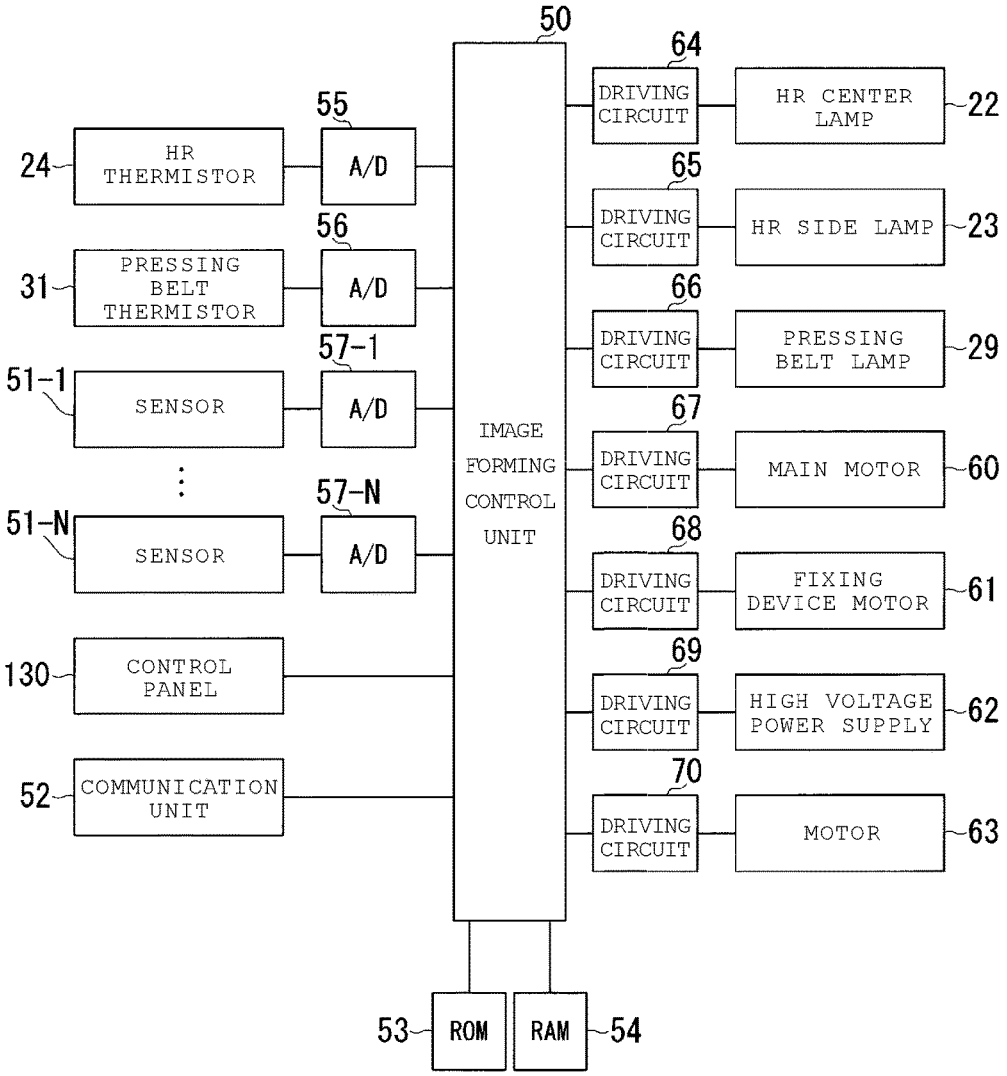
FIG. 5 is a block diagram of the image forming apparatus according to the embodiment.

FIG. 5 is a block diagram of the image forming apparatus 1 according to the present embodiment. The image forming apparatus 1 includes an image forming control unit 50, sensors 51-1 to 51-N (N is an integer of 1 or greater), a communication unit 52, a ROM 53, a RAM 54, analog-to-digital (A/D) converters 55 and 56, A/D converters 57-1 to 57-N, a main motor 60, a fixing device motor 61, a high voltage power supply 62, a motor 63, and driving circuits 64 to 70 in addition to the control panel 130, the HR center lamp 22, the HR side lamp 23, the HR thermistor 24, the pressing belt lamp 29, and the pressing belt thermistor 31, which are described above.

Hereinafter, when the sensors are not particularly distinguished, the sensor is simply described as the sensor 51. Hereinafter, when the A/D converter is not distinguished among the A/D converters 57-1 to 57-N, the A/D converter is simply described as the A/D converter 57.

The image forming control unit 50 is a specific example of a control unit. The image forming control unit 50 includes a central processing unit (CPU). The image forming control unit 50 controls operations of the image forming apparatus, including an operation to control the temperature of the fixing device 20.

Input devices connected to the image forming control unit 50 include the HR thermistor 24, the pressing belt thermistor 31, the sensor 51, the control panel 130, and the communication unit 52. Output devices connected to the image forming control unit 50 include the HR center lamp 22, the HR side lamp 23, the pressing belt lamp 29, the main motor 60, the fixing device motor 61, the high voltage power supply 62, and the motor 63.

First, the input devices connected to the image forming control unit 50 will be described below.

The HR thermistor 24 outputs a signal to the image forming control unit 50 via the A/D converter 55. The HR thermistor 24 outputs a signal indicating the temperature of the front surface of the heating roller 21 to the image forming control unit 50.

The pressing belt thermistor 31 outputs a signal to the image forming control unit 50 via the A/D converter 56. The pressing belt thermistor 31 outputs a signal indicating the temperature of the front surface of the pressing belt 25 to the image forming control unit 50.

The sensor 51 measures physical quantity that is used for controlling the image formation. The sensor 51 outputs a signal indicating the measured physical quantity to the image forming control unit 50 via the A/D converter 57.

The control panel 130 outputs a signal indicating a user's instruction received by the control panel 130 to the image forming control unit 50. For example, the control panel 130 outputs a printing instruction from a user. In this case, the image forming control unit 50 forms an image in accordance with the printing instruction from the user.

The communication unit 52 performs communication with an external apparatus. The communication unit 52 may perform communication with the external apparatus in a wired manner or a wireless manner. The external apparatus is, for example, an information terminal such as a computer. The communication unit 52 receives a signal indicating a user's instruction and outputs the signal to the image forming control unit 50.

Next, the output devices connected to the image forming control unit 50 will be described below.

The image forming control unit 50 controls the operation of the HR center lamp 22 via the driving circuit 64. The image forming control unit 50 controls the temperature of the heating roller 21 by controlling an operating time of the HR center lamp 22, for example. Alternatively, or in combination thereto, the image forming control unit 50 may control the temperature of the heating roller 21 by controlling the output power of the HR center lamp 22.

The image forming control unit 50 controls the operation of the HR side lamp 23 via the driving circuit 65. The image forming control unit 50 controls the temperature of the heating roller 21 by controlling an operating time of the HR side lamp 23. Alternatively, or in combination thereto, the image forming control unit 50 may control the temperature of the heating roller 21 by controlling the output power of the HR side lamp 23.

The image forming control unit 50 controls the operation of the pressing belt lamp 29 via the driving circuit 66. The image forming control unit 50 controls the temperature of the pressing belt 25 by controlling the operating time of the pressing belt lamp 29, for example. Alternatively, or in combination thereto, the image forming control unit 50 may control the temperature of the pressing belt 25 by controlling the output power of the pressing belt lamp 29.

The image forming control unit 50 controls the operation of the main motor 60 via the driving circuit 67. The image forming control unit 50 controls the operation of the fixing device motor 61 via the driving circuit 68. The image forming control unit 50 controls the operation of the high voltage power supply 62 via the driving circuit 69. The image forming control unit 50 controls the operation of the motor 63 via the driving circuit 70.

The driving circuits 64 to 70 each include a switching circuit, an analog-to-digital (A/D) converter, or the like.

The main motor 60 causes a photosensitive drum, such as the photosensitive drum 12*b*, of each of the image forming units 12 to 15 to rotate through a driving mechanism.

The fixing device motor 61 causes the heating roller 21 to rotate through a driving mechanism.

The high voltage power supply 62 and the motor 63 perform an operation for forming an image. In FIG. 5, one high voltage power supply 62 and one motor 63 are illustrated, but plural high voltage power supplies 62 and plural motors 63 may be provided.

The ROM 53 stores a control program and control data. The ROM 53 is connected to the image forming control unit 50.

The RAM 54 retains a control parameter and operation data of the image forming apparatus 1. The RAM 54 retains, for example, a number of sheets of printed by the image forming apparatus 1. The RAM 54 is connected to the image forming control unit 50.

The decolorable toner used in the present embodiment is manufactured through the following process.

First, manufacturing of an atomized liquid containing a binder resin will be described. As the binder resin, a polyester (Pes) resin of which the glass transition temperature Tg is 50° C. and the softening point is 100° C. is used. 30 parts by mass of the Pes resin, 3 parts by mass of an anionic emulsifier (NEOPELEX G15 manufactured by Kao Corporation), and 0.6 parts by mass of a neutralizer (dimethylaminoethanol) are used to prepare a dispersion liquid (atomized liquid) of particles including a binder resin. The dispersion liquid is prepared using a high-pressure homogenizer.

Next, manufacturing a releasing agent atomized liquid will be described. The releasing agent atomized liquid is manufactured with 30 parts by mass of rice WAX through the same method as the method for manufacturing the binder resin.

Next, manufacturing of a coloring agent will be described. A mixture of 1 part by mass of 3-(2-ethoxy-4-diethylaminophenyl)-3-(1-ethyl-2-methylindole-3-yl)-4-azaphthalide as a leuco dye, 5 part by mass of 2,2-bis(4-hydroxyphenyl) hexafluoropropane as a developer, and 50 parts by mass of a diester compound of pimelic acid and 2-(4-benzyloxyphenyl)ethanol as a decolorant (temperature control agent) is heated and dissolved. Further, a liquid in which 20 parts by mass of an aromatic polyvalent isocyanate prepolymer as an encapsulation agent and 40 parts by mass of ethyl acetate are mixed is added to 250 parts by mass of 8% polyvinyl alcohol aqueous solution, and is emulsified and dispersed. After the resultant liquid is continuously stirred at 70° C. for about 1 hour, 2 parts by mass of a water-soluble aliphatic modified amine as reactant is added thereto, and then the resultant liquid is continuously stirred at 90° C. for about 3 hours to obtain a colorless capsule particle. Further, the capsule particle dispersion is put into a freezer (−30° C.) to be color-developed. As a result, a blue coloring agent is obtained. When a color-developed particle C1 is measured by SALD7000 manufactured by Shimadzu Corporation, a volume average particle size thereof is 2 μm.

Next, an aggregation process and a fusion process will be described. 10 parts by mass of an encapsulated coloring agent, 283 parts by mass of an atomized liquid containing a binder resin, and 17 parts by mass of a releasing agent atomized liquid are aggregated at 45° C. using 100 parts by mass of aluminum sulfate ($Al_2(SO_4)_3$) 5% as aqueous solution. Then, the resultant liquid is heated to the temperature of 65° C. (an increasing rate of temperature: 1° C./minute) to be fused, and is subjected to washing and drying to obtain a decolorable capsule toner. The amount of the coloring agent in the decolorable capsule toner is 10% by mass.

The temperature of the toner when the color is completely decolored is 107° C., the temperature when the color starts to be decolored is 88° C., and the temperature when the color is completely developed is −5° C.

Figure 6:
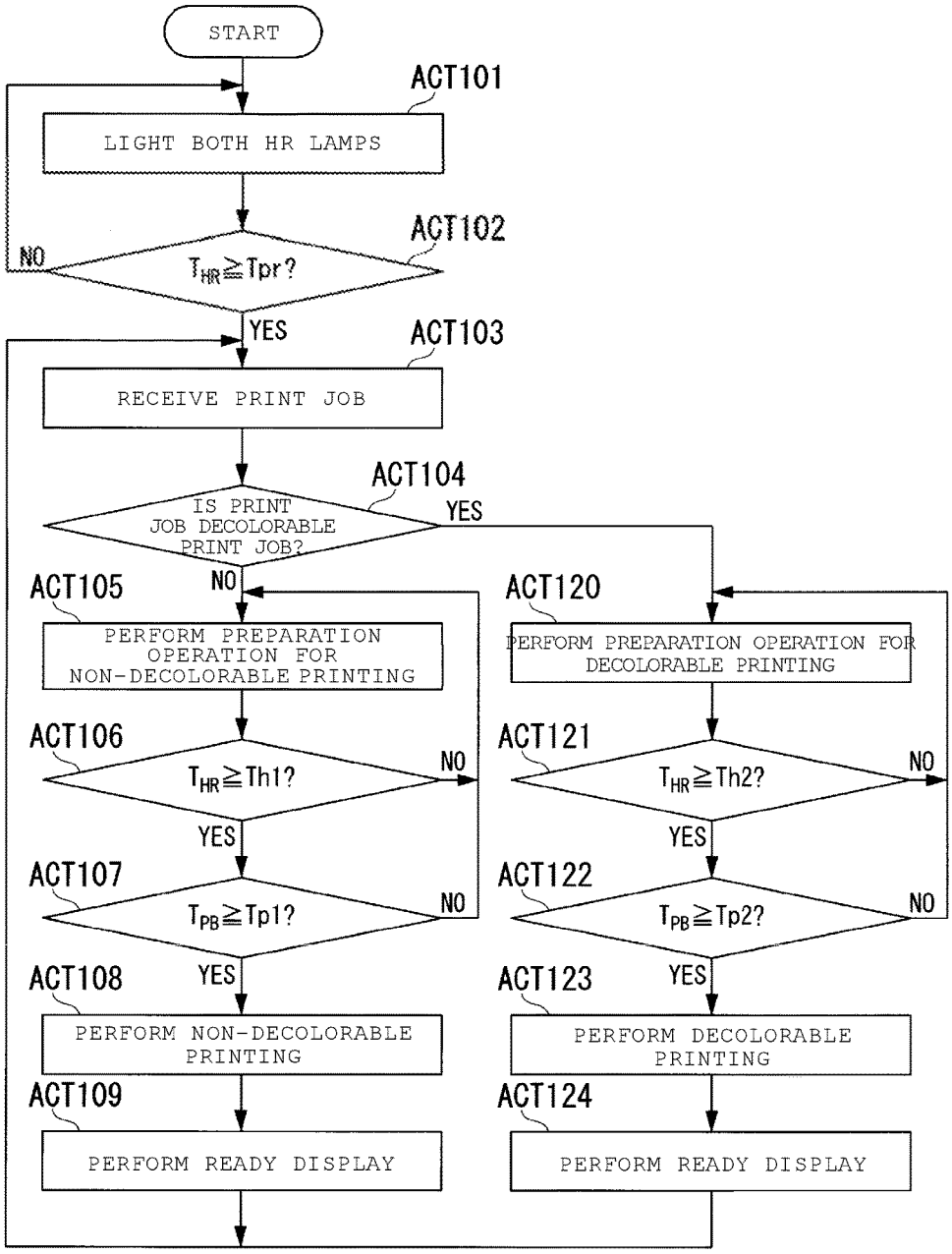
FIGS. 6-8 are each a flowchart illustrating an example of a process performed by the image forming apparatus according to the embodiment.

FIG. 6 is a flowchart illustrating an example of a process performed by the image forming apparatus 1 according to the present embodiment. The image forming apparatus 1 starts the process when the power is supplied to the image forming apparatus 1 or when the image forming apparatus 1 returns from a sleep state. First, the image forming control unit 50 performs a preparation operation for the image formation. The image forming control unit 50 turns on both (hereinafter, referred to as "both HR lamps") of the HR center lamp 22 and the HR side lamp 23 (ACT101). When the both HR lamps are turned on, the heating roller 21 starts to be heated.

After the HR lamps 22 and 23 are turned on, the image forming control unit 50 determines whether a temperature $T_{HR}$ of the heating roller 21 is equal to or higher than a pre-run starting temperature $T_{pr}$ (ACT102). When the temperature $T_{HR}$ is not equal to or higher than the temperature $T_{pr}$ (NO in ACT102), the process returns to ACT101. The pre-run starting temperature $T_{pr}$ is, for example, 100° C.

When the temperature $T_{HR}$ is equal to or higher than the temperature $T_{pr}$ (YES in ACT102), the image forming control unit 50 receives a print JOB (ACT103). The print JOB is, for example, a user's instruction received by the control panel 130 or a printing instruction received by an external apparatus.

After the print JOB is received, the image forming control unit 50 determines whether the print JOB is an instruction for image formation with a decolorable agent (hereinafter, referred to as "decolorable print JOB") (ACT104).

If the print JOB is not the decolorable print JOB (NO in ACT104), the image forming control unit 50 performs a preparation operation for the non-decolorable printing (ACT105). The preparation operation for the non-decolorable printing is a kind of a preparation operation for the image formation. The image forming control unit 50 performs a pre-run operation as the preparation operation for the non-decolorable printing, and alternately turns on and off the HR center lamp 22 and the HR side lamp 23. At this time, the pressing belt lamp 29 is still turned off. During the pre-run operation, the heating roller 21 and the pressing belt 25 are driven.

Next, the image forming control unit 50 determines whether the temperature $T_{HR}$ is equal to or higher than a non-decolorable printing setting temperature Th1 (ACT106). If the temperature $T_{HR}$ is not equal to or higher than the temperature Th1 (NO in ACT106), the process returns to ACT105. The non-decolorable printing setting temperature Th1 is, for example, 120° C.

If the temperature $T_{HR}$ is equal to or higher than the temperature Th1 (YES in ACT106), the image forming control unit 50 determines whether a temperature $T_{PB}$ is equal to or higher than a temperature Tp1 (ACT107). The temperature $T_{PB}$ is the temperature of the pressing belt 25. The temperature Tp1 is the non-decolorable printing setting temperature. If the temperature $T_{PB}$ is not equal to or higher than the temperature Tp1 (NO in ACT107), the process returns to ACT105. The non-decolorable printing setting temperature Tp1 is, for example, 50° C.

If the temperature $T_{PB}$ is equal to or higher than the temperature Tp1 (YES in ACT107), the image forming control unit 50 performs the non-decolorable printing (ACT108). That is, an image is formed on a sheet with a non-decolorable agent.

After the non-decolorable printing is performed, the image forming control unit 50 performs a ready display (ACT109). The image forming control unit 50 causes the display unit 131 to display information indicating, for example, a state in which the printing is available. After the image forming control unit 50 performs the ready display, the process returns to ACT103.

If the print JOB is the decolorable print JOB (YES in ACT104), the image forming control unit 50 performs a preparation operation for the decolorable printing (ACT120). The preparation operation for the decolorable printing is a kind of a preparation operation for the image formation. The image forming control unit 50 alternately turns on and off the HR center lamp 22 and the HR side lamp 23 as the preparation operation for the decolorable printing, and turns on the pressing belt lamp 29. The image forming control unit 50 may perform the pre-run operation while the lamps are turned on. The heating roller 21 is heated by the HR center lamp 22 and the HR side lamp 23. The pressing belt 25 is heated by the pressing belt lamp 29. The temperature of the pressing belt 25 is equalized over the entire length of the pressing belt 25 by the pre-run operation.

Next, the image forming control unit 50 determines whether the temperature $T_{HR}$ is equal to or higher than a decolorable printing setting temperature Th2 (ACT121). If the temperature $T_{HR}$ is not equal to or higher than the temperature Th2 (NO in ACT121), the process returns to ACT120. The decolorable printing setting temperature Th2 is, for example, 100° C.

If the temperature $T_{HR}$ is equal to or higher than the temperature Th2 (YES in ACT121), the image forming control unit 50 determines whether the temperature $T_{PB}$ is equal to or higher than the temperature Tp2 (ACT122). The temperature Tp2 is a decolorable printing setting temperature. The decolorable printing setting temperature Tp2 is, for example, 90° C. If the temperature $T_{PB}$ is not equal to or higher than the temperature Tp2 (NO in ACT122), the process returns to ACT120.

If the temperature $T_{PB}$ is equal to or higher than the temperature Tp2 (YES in ACT122), the image forming control unit 50 performs the decolorable printing (ACT123). That is, an image is formed on a sheet with a decolorable agent.

After the decolorable printing is performed, the image forming control unit 50 performs a ready display as a standby state (ACT124). The image forming control unit 50 causes the display unit 131 to display information indicating, for example, that the printing is available. After the image forming control unit 50 performs the ready display, the process returns to ACT103.

Figure 7:
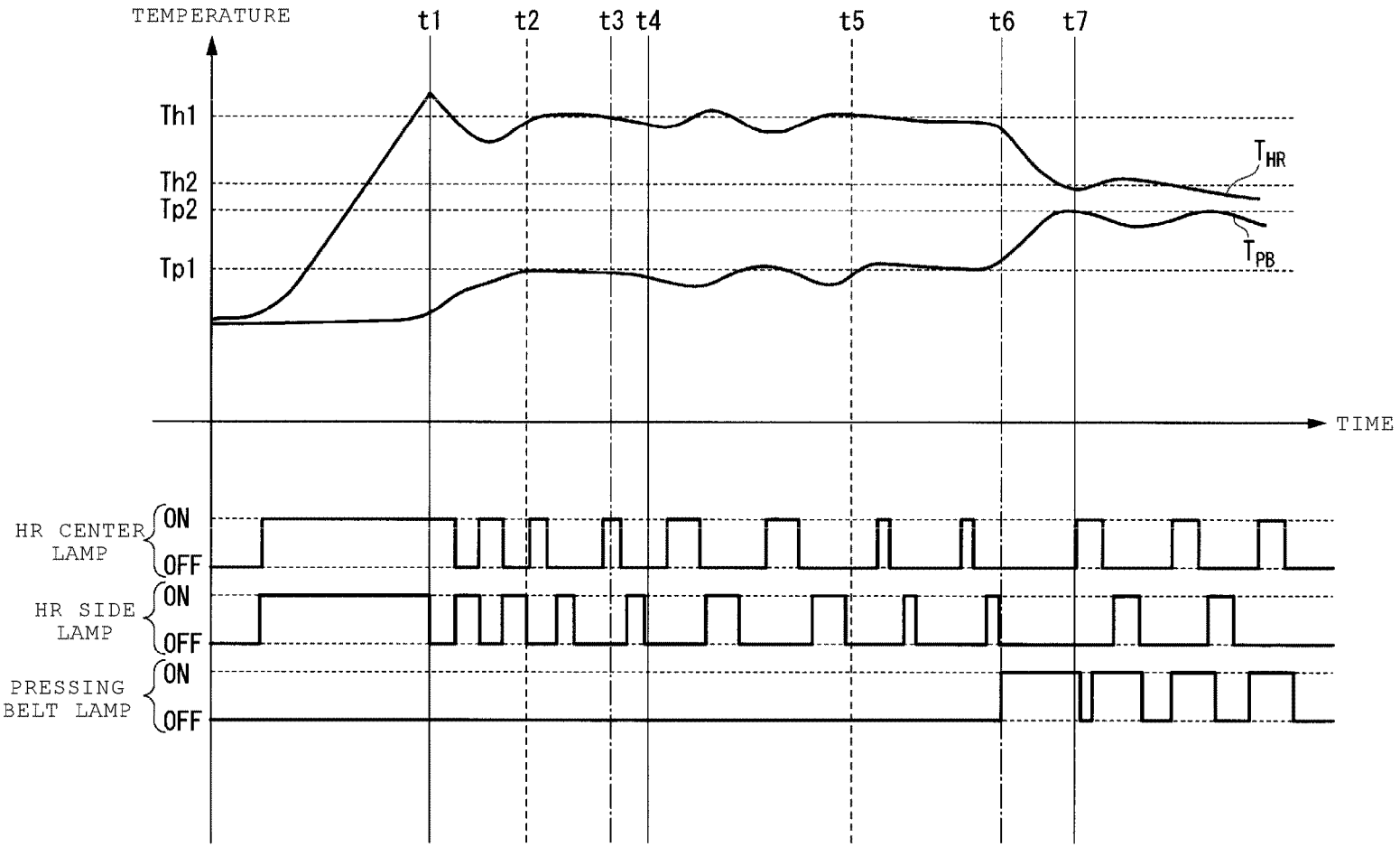

FIG. 7 illustrates an example of an operation carried out by the image forming apparatus 1.

FIG. 7 illustrates the temperature $T_{HR}$ of the heating roller 21, the temperature $T_{PB}$ of the pressing belt 25, and on/off states of the HR center lamp 22, the HR side lamp 23, and the pressing belt lamp 29. FIG. 7 illustrates a case in which the image forming apparatus 1 receives the non-decolorable print JOB after the image forming apparatus 1 turns into a standby state, and then receives the decolorable print JOB. In the standby state, the non-decolorable printing is available and the image forming apparatus 1 performs a ready display.

First, after the power is supplied to the image forming apparatus 1 or the image forming apparatus 1 returns from a sleep state, the image forming control unit 50 turns on the HR center lamp 22 and the HR side lamp 23. The heating roller 21 is heated by the HR center lamp 22 and the HR side lamp 23. Accordingly, the temperature $T_{HR}$ increases.

When the temperature $T_{HR}$ becomes equal to or higher than the temperature $T_{pr}$ at time t1, the image forming control unit 50 starts the preparation operation for the non-decolorable printing. That is, the image forming control unit 50 alternately turns on and off the HR center lamp 22 and the HR side lamp 23, and performs the pre-run operation. At this time, the image forming control unit 50 causes the pressing belt lamp 29 to be still turned off.

Heat capacity of the pressing belt 25 is larger than heat capacity of the heating roller 21. For this reason, if the pressing belt 25 is also heated before time T1, it would take longer time to complete warm-up of the fixing device 20. To reduce time for the warm-up, only the heating roller 21 is heated until time T1. This heating method makes it possible to reduce heating energy to complete the warm-up. Here, the temperature Th1 is high enough to fix toner even if the pressing belt 25 is not heated.

During the pre-run operation, heat is transferred from the heating roller 21 to the pressing belt 25. Therefore, the temperature $T_{PB}$ increases immediately after the power is supplied.

When the temperature $T_{HR}$ reaches the temperature Th1 at time t2, the image forming control unit 50 performs the ready display. The temperature Th1 is high enough to fix non-decolorable toner even if the pressing belt 25 is not heated by the pressing belt lamp 29. Further, the image forming control unit 50 may perform the ready display based on whether the temperature $T_{PB}$ reaches the temperature Tp1.

At time t3, the image forming control unit 50 receives the non-decolorable print JOB.

During a period between time t4 and time t5, the image forming control unit 50 performs the non-decolorable printing. The image forming control unit 50 controls the HR lamps 22 and during the non-decolorable printing, such that the temperature $T_{HR}$ is roughly equal to the temperature Th1.

At time t5, the image forming control unit 50 performs the ready display after the non-decolorable printing has been completed.

At time t6, the image forming control unit 50 receives the decolorable print JOB.

From time t6, the image forming control unit 50 performs preparation for the decolorable print JOB. The image forming control unit 50 controls the HR center lamp 22 and the HR side lamp 23 so as to cause the temperature $T_{HR}$ to become the temperature Th2. The image forming control unit 50 controls the pressing belt lamp 29 so as to cause the temperature $T_{PB}$ to reach the decolorable printing setting temperature Tp2. At this time, the image forming control unit 50 may perform the pre-run operation.

When the temperature $T_{HR}$ reaches the temperature Th2 and the temperature $T_{PB}$ reaches the temperature Tp2 at time t7, the image forming control unit 50 starts the decolorable printing. The image forming control unit 50 controls the HR lamps 22 and 23 during the decolorable printing, such that the temperature $T_{HR}$ has a value around the temperature Th2. The image forming control unit 50 controls the pressing belt lamp 29 during the decolorable printing, such that the temperature $T_{PB}$ is roughly equal to the temperature Tp2.

Figure 8:
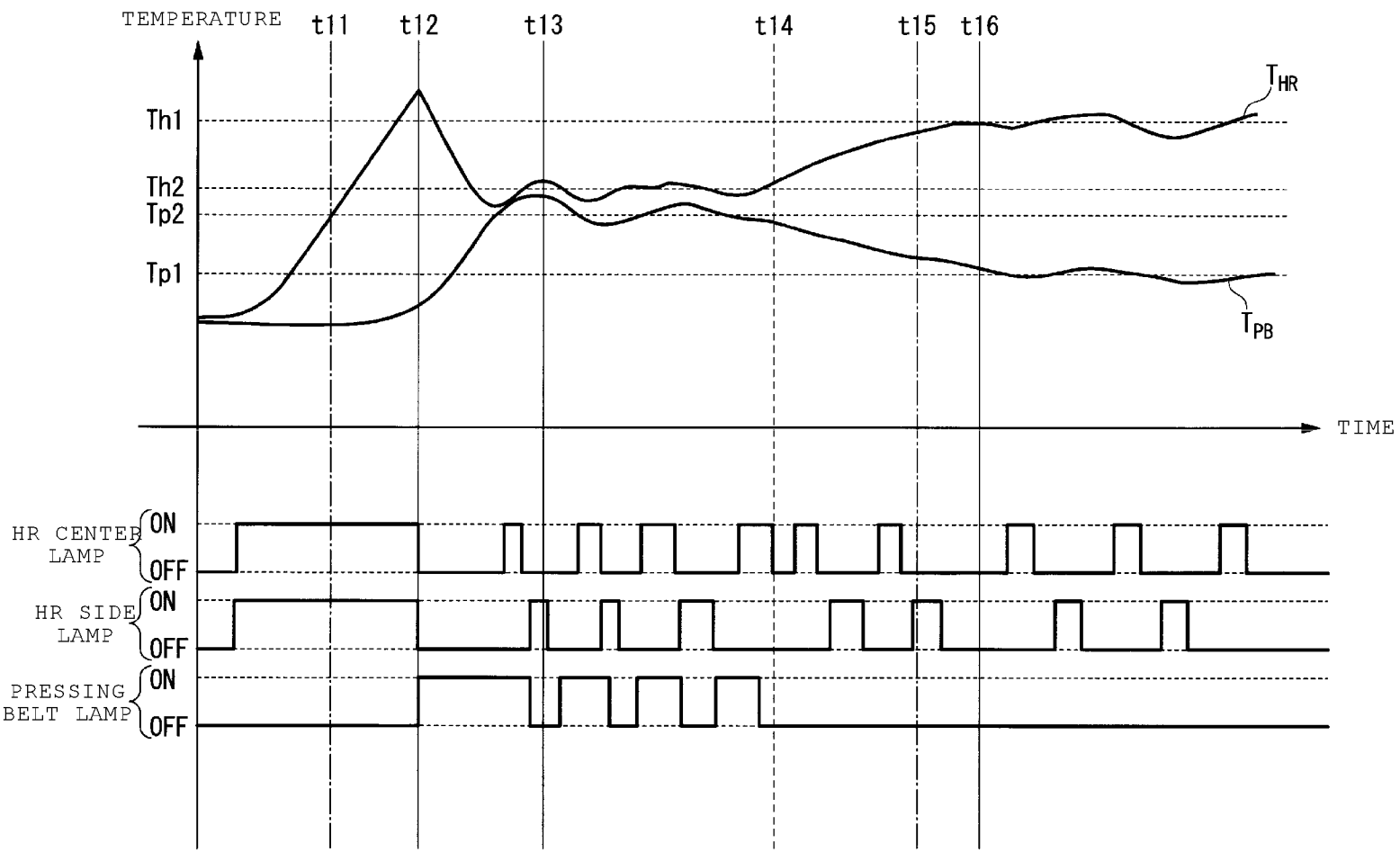

FIG. 8 illustrates another example of an operation carried out by the image forming apparatus 1.

FIG. 8 illustrates the temperature $T_{HR}$ of the heating roller 21, the temperature $T_{PB}$ of the pressing belt 25, and the on/off states of the HR center lamp 22, the HR side lamp 23, and the pressing belt lamp 29. FIG. 8 illustrates a case in which the image forming apparatus 1 receives the decolorable print JOB before turning into the standby state, and then receives the non-decolorable print JOB.

First, after the power is supplied to the image forming apparatus 1 or the image forming apparatus 1 returns from a sleep state, the image forming control unit 50 turns on the HR center lamp 22 and the HR side lamp 23. The heating roller 21 is heated by the HR center lamp 22 and the HR side lamp 23. As a result, the temperature $T_{HR}$ increases.

At time t11, the image forming control unit 50 receives the decolorable print JOB.

When the temperature $T_{HR}$ becomes equal to or higher than the temperature $T_{pr}$ at time t12, the image forming control unit 50 starts preparation for printing. At this time, the image forming control unit 50 starts preparation for decolorable printing based on the decolorable print JOB received at time t11. That is, the image forming control unit 50 controls the HR center lamp 22 and the HR side lamp 23 so as to cause the temperature $T_{HR}$ to reach the temperature Th2. Further, the image forming control unit 50 controls the lamp of the pressing belt lamp 29 so as to cause the temperature $T_{PB}$ to reach the temperature Tp2. At this time, the image forming control unit 50 may perform the pre-run operation.

When the temperature $T_{HR}$ becomes the temperature Th2 and the temperature $T_{PB}$ reaches the temperature Tp2 at time t13, the image forming control unit 50 start the decolorable printing. The image forming control unit 50 controls the both HR lamps during the decolorable printing, such that the temperature $T_{HR}$ is roughly equal to the temperature Th2. The image forming control unit 50 controls the pressing belt lamp 29 during the decolorable printing, such that the temperature $T_{PB}$ is roughly equal to the temperature Tp2.

At time t14, the image forming control unit 50 performs the ready display after the decolorable printing has been completed. Also, the image forming control unit 50 causes the pressing belt lamp 29 to be turned off. Further, the image forming control unit 50 controls the HR center lamp 22 and the HR side lamp 23 in order to cause the temperature $T_{HR}$ to reach the temperature Th1.

At time t15, the image forming control unit 50 receives the non-decolorable print JOB.

When the temperature $T_{HR}$ reaches the temperature Th1 at time t16, the image forming control unit 50 starts the non-decolorable printing. The image forming control unit 50 controls the HR center lamp 22 and the HR side lamp 23 during the non-decolorable printing, such that the temperature $T_{HR}$ is roughly equal to the temperature Th1.

In the image forming apparatus 1 configured as described above, the preparation operation for the non-decolorable printing is set as a standard preparation operation for the printing. The image forming apparatus 1 heats the fixing member of the fixing device 20 to the non-decolorable printing setting temperature by the first heater as the preparation operation for the non-decolorable printing. The non-decolorable printing setting temperature of the fixing member is set to be higher than the non-decolorable printing setting temperature of the pressing member. Therefore, the image forming apparatus 1 causes the energy consumed by the second heater per unit time, which heats the pressing member, to be lower than the energy consumed by the first heater. Accordingly, the image forming apparatus 1 can reduce the energy consumption for the printing preparation. In addition, the image forming apparatus 1 can reduce the energy consumption for the printing (image formation). In addition, the image forming apparatus 1 suppresses the energy consumed by the second heater, and increases the energy consumed by the first heater. Therefore, the image forming apparatus 1 can shorten the time required for the printing preparation.

When the non-decolorable printing setting temperature of the pressing member is set to be low, the image forming apparatus 1 can reduce the energy consumed by the second heater per unit time, which heats the pressing member.

Particularly, when the temperature of the pressing member is less likely to increase than that of the fixing member with the same amount of heat generation (e.g., heat capacity of the pressing member is greater than that of the fixing member), the image forming apparatus 1 can reduce the energy consumption for the printing preparation. In addition, the image forming apparatus 1 can shorten the time required for the printing preparation.

When the image forming apparatus 1 performs the non-decolorable printing after the decolorable printing has been completed, the image forming apparatus 1 performs a preparation operation for the non-decolorable printing. The fixing member immediately after the decolorable printing has been completed is at a temperature roughly equal to the decolorable printing setting temperature. The pressing member immediately after the decolorable printing has been completed is at a temperature roughly equal to the decolorable printing setting temperature. The non-decolorable printing setting temperature of the fixing member is higher than the decolorable printing setting temperature of the fixing member. The image forming apparatus 1 heats the fixing member to the non-decolorable printing setting temperature as the preparation operation for the non-decolorable printing. When the non-decolorable printing setting temperature of the pressing member is lower than the decolorable printing setting temperature, the image forming apparatus 1 can suppress the energy consumption by the second heater. Accordingly, the image forming apparatus 1 can reduce the energy consumption for the printing preparation. In addition, the image forming apparatus 1 suppresses the energy consumption by the second heater, and increases the energy consumption by the first heater. Therefore, the image forming apparatus 1 can shorten the time required for the printing preparation.

When the decolorable printing is performed, the image forming apparatus 1 controls the temperature of the heating roller 21 to be lower than the temperature thereof when the non-decolorable printing is performed. When the decolorable printing is performed, the image forming apparatus 1 controls the temperature of the pressing belt 25 to be equal to or higher than the temperature thereof when the non-decolorable printing is performed. Accordingly, the image forming apparatus 1 can fix an image with a decolorable agent on a sheet favorably without decoloring the decolorable agent.

Next, a modification example of the image forming apparatus 1 will be described.

In the fixing device 20, the heating roller 21 includes two lamps of the HR center lamp 22 and the HR side lamp 23, but may have one lamp or three or more lamps.

In ACT104 of FIG. 6, the image forming control unit 50 may determine whether the decolorable print JOB is included in a plurality of spooled print JOBs.

According to at least one embodiment described above, the image forming apparatus has a function for respectively controlling the temperature of each member of a fixing device that fixes an image formed with a coloring agent on a sheet. As a result, it is possible to suppress energy consumption.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device, comprising:
a roller;
a presser pressed against the roller;
a heater configured to heat the presser; and
a controller configured to control the heater, such that a heat generation per unit time by the heater when an image of a decolorable material is fixed by the fixing device is greater than a heat generation per unit time by the heater when an image of a non-decolorable material is fixed by the fixing device.

2. The fixing device according to claim 1, wherein
the controller is further configured to control the heater, such that a temperature of the presser when the image of the decolorable material is fixed by the fixing device is higher than the temperature of the presser when the image of the non-decolorable material is fixed by the fixing device.

3. The fixing device according to claim 1, further comprising:
a second heater configured to heat the roller, wherein
the controller is further configured to control the second heater, such that a heat generation per unit time by the second heater when the image of the decolorable material is fixed by the fixing device is smaller than a heat generation per unit time by the second heater when the image of the non-decolorable material is fixed by the fixing device.

4. The fixing device according to claim 3, wherein
the controller is further configured to control the second heater, such that a temperature of the roller when the image of the decolorable material is fixed by the fixing device is lower than the temperature of the roller when the image of the non-decolorable material is fixed by the fixing device.

5. The fixing device according to claim 3, wherein
the controller is further configured to control the second heater when the fixing device is turned on, such that a temperature of the roller becomes a temperature of the roller to fix the non-decolorable material.

6. The fixing device according to claim 5, wherein
the controller is further configured to not turn on the heater when the fixing device is turned on.

7. The fixing device according to claim 3, wherein
the controller is further configured to control the heater and the second heater after a sheet having the image of the decolorable material has been passed through a nip formed between the roller and the presser, such that a temperature of the roller increases and a temperature of the presser decreases.

8. The fixing device according to claim 3, wherein
the second heater includes a center heater and a side heater arranged in a width direction of the roller, and
the controller is configured to alternately turn on and off the center heater and the side heater when a sheet is passed through a nip formed between the roller and the presser for fixing.

9. The fixing device according to claim 1, wherein
the presser is an endless belt, and
heat capacity of the endless belt is greater than heat capacity of the roller.

10. An image forming apparatus, comprising:
an image forming device configured to form an image on a sheet;
a fixing device configured to fix the image on the sheet, the fixing device including:
a roller,
a presser pressed against the roller, and
a heater configured to heat the presser; and
a controller configured to control the heater, such that a heat generation per unit time by the heater when an image of a decolorable material is fixed by the fixing device is greater than a heat generation per unit time by the heater when an image of a non-decolorable material is fixed by the fixing device.

11. The image forming apparatus according to claim 10, wherein
the controller is further configured to control the heater, such that a temperature of the presser when the image of the decolorable material is fixed by the fixing device is higher than the temperature of the presser when the image of the non-decolorable material is fixed by the fixing device.

12. The image forming apparatus according to claim 10, wherein
the fixing device further includes a second heater configured to heat the roller, and
the controller is further configured to control the second heater, such that a heat generation per unit time by the second heater when the image of the decolorable material is fixed by the fixing device is smaller than a heat generation per unit time by the second heater when the image of the non-decolorable material is fixed by the fixing device.

13. The image forming apparatus according to claim 12, wherein
the controller is further configured to control the second heater, such that a temperature of the roller when the image of the decolorable material is fixed by the fixing device is lower than the temperature of the roller when the image of the non-decolorable material is fixed by the fixing device.

14. The image forming apparatus according to claim 12, wherein the controller is further configured to control the second heater when the fixing device is turned on, such that a temperature of the roller becomes a temperature of the roller to fix the non-decolorable material.

15. The image forming apparatus according to claim 14, wherein the controller is further configured to not turn on the heater when the fixing device is turned on.

16. The image forming apparatus according to claim 12, wherein the controller is further configured to control the heater and the second heater after a sheet having the image of the decolorable material has been passed through a nip formed between the roller and the presser, such that a temperature of the roller increases and a temperature of the presser decreases.

17. The image forming apparatus according to claim 12, wherein the second heater includes a center heater and a side heater arranged in a width direction of the roller, and the controller is configured to alternately turn on and off the center heater and the side heater when a sheet is passed through a nip formed between the roller and the presser for fixing.

18. The image forming apparatus according to claim 10, wherein the presser is an endless belt, and heat capacity of the endless belt is greater than heat capacity of the roller.

19. A method for fixing an image on a sheet by a fixing device having a roller, a presser that is pressed against the roller, and a heater to heat the presser, the method comprising:

conveying a first sheet having an unfixed image of a decolorable material through a nip formed between the roller and the presser;

conveying a second sheet having an unfixed image of a non-decolorable material through the nip; and controlling the heater, when the first and second sheets are conveyed through the nip, wherein a heat generation per unit time by the heater when the first sheet is conveyed through the nip is greater than a heat generation per unit time by the heater when the second sheet is conveyed through the nip.

20. The method according to claim 19, wherein a temperature of the presser when the first sheet is conveyed through the nip is higher than the temperature of the presser when the second sheet is conveyed through the nip.

* * * * *